US007458887B2

(12) United States Patent
Kurosawa

(10) Patent No.: US 7,458,887 B2
(45) Date of Patent: Dec. 2, 2008

(54) REMAINING COIN AMOUNT DETECTING APPARATUS FOR COIN HOPPER

(75) Inventor: Motoharu Kurosawa, Saitama (JP)

(73) Assignee: Asahi Seiko Company Ltd., Saitama-ken (JP)

( * ) Notice: Subject to any disclaimer, the term of this patent is extended or adjusted under 35 U.S.C. 154(b) by 126 days.

(21) Appl. No.: 11/684,172

(22) Filed: Mar. 9, 2007

(65) Prior Publication Data

US 2007/0212997 A1 Sep. 13, 2007

(30) Foreign Application Priority Data

Mar. 13, 2006 (JP) ..... 2006-067090

(51) Int. Cl.
*G07D 1/00* (2006.01)
*H01R 39/00* (2006.01)
*H01R 39/28* (2006.01)

(52) U.S. Cl. ..... 453/57; 439/8

(58) Field of Classification Search ..... 453/57
See application file for complete search history.

(56) References Cited

U.S. PATENT DOCUMENTS 4,541,444 A * 9/1985 Okada ..... 453/17

FOREIGN PATENT DOCUMENTS

| | | |
|---|---|---|
| JP | 63-24389 | 2/1988 |
| JP | 63-29894 | 2/1988 |
| JP | 7-160919 | 6/1995 |

* cited by examiner

*Primary Examiner*—Patrick Mackey
*Assistant Examiner*—Mark Beauchaine
(74) *Attorney, Agent, or Firm*—McGlew & Tuttle, P.C.

(57) ABSTRACT

A remaining coin amount detecting apparatus is provided for a coin hopper, disposed on a lower portion of a cylindrical storing bowl. The coin hopper dispenses coins one by one using a rotary disk fixed on a rotary shaft rotated by a driving apparatus. At least a part of a surface of the rotary disk includes a conductor, and the conductor is electrically connected to a detecting terminal disposed inside the storing bowl.

15 Claims, 5 Drawing Sheets

REMAINING COIN AMOUNT DETECTING APPARATUS FOR COIN HOPPER

CROSS REFERENCE TO RELATED APPLICATIONS

This application claims the benefit of priority under 35 U.S.C. § 119 of Japan Patent Application JP 2006-067090 filed Mar. 13, 2006, the entire contents of which are incorporated herein by reference.

FIELD OF THE INVENTION

The present invention relates to a coin hopper which separates and dispenses coins one by one using a rotary disk. In detail, the present invention relates to a remaining coin amount detecting apparatus for a coin hopper which detects an amount of coins remaining in a storing bowl of the coin hopper. The term "coin" used in this text is a general term for a circular disk, such as a coin (currency), a token and the like.

BACKGROUND OF THE INVENTION

In a coin hopper which dispenses coins one by one using a rotary disk disposed on a lower portion of a cylindrical storing bowl, various kinds of techniques have been proposed to detect an amount of coins remaining in the storing bowl.

JP-A-07-1600919 (see FIG. 1, Pages. 3 to 4) presents an example of a first conventional practice or state of the art. A device is provided in which a pair of electrodes is mounted on a side wall of the storing bowl. When these electrodes are not electrically conducting as to each other via stored coins having conductivity, a coin empty signal is output. In other words, when enough coins are stored in the storing bowl, the pair of electrodes conduct as to each other through conductive coins. However, when a coin retaining amount is reduced, the pair of electrodes is not conductive as to each other by the conductive coins, the coin empty signal is output.

JP-A-63-24389 (see FIG. 2, Pages. 2 to 3) presents features of a second conventional practice from the prior art in which a flexible electrode is fixed on a wall face of a storing bowl. A metallic base, on which a coin that drops through a through-hole of a rotary disk slides, is constituted as an electrode paired with the flexible electrode. When these electrodes are not electrically conductive as to each other, an empty signal is output.

JP-A-63-29894 (see FIG. 1, Page. 2) presents features of a third conventional practice from the prior art, which uses a photoelectronic sensor whose optical axis is disposed in a crossing manner just above an upper face of a rotary disk.

According to what is disclosed in JP-A-07-1600919, since the pair of electrodes is fixed on the side wall of the storing bowl, these electrodes must be disposed separately from each other by a predetermined distance or more, and since the pair of electrodes is disposed above the rotary disk, the empty signal is output in a state in which a remaining coin amount is relatively large, so that there is a problem that a coin replenishing interval is shortened.

According to what is disclosed in JP-A-63-24389, since coins are detected when the flexible electrode, which can enter the through hole of the rotary disk and the base on which a coin slides, are conductive as to each other by coins, and the empty signal is output when they are not conductive as to each other via coins, there is an advantage that the empty signal can be output in a state in which a remaining coin amount is small. However, this cannot be applied when a base is a non-conductive material such as resin.

According to what is disclosed in JP-A-63-29894, since the optical axis for the remaining coin detection must cover a certain detection range, a plurality of photoelectronic sensors must be disposed, which results in a high price. As such, this is difficult to be adopted readily. Further, when the photoelectronic sensor is used, there is a problem that such maintenance as cleaning a light projecting and receiving face periodically is required.

SUMMARY OF THE INVENTION

A first object of the present invention is to provide a remaining coin amount detecting apparatus for a coin hopper which can detect a remaining coin amount in a storing bowl in a state in which the amount of remaining coins is as small as possible.

A second object of the present invention is to provide a remaining coin amount detecting apparatus for a coin hopper which can detect a remaining coin amount in a storing bowl in a state in which the amount of remaining coins is as small as possible even in a case in which a base is made of a non-conductive material.

A third object of the present invention is to provide a remaining coin amount detecting apparatus for a coin hopper which can detect a remaining coin amount in a storing bowl in a state in which the amount of coins remaining is as small as possible, and which does not require periodical maintenance.

In order to achieve the objects, a coin hopper is configured according to the invention such that a remaining coin amount detecting apparatus is disposed on a lower portion of a cylindrical storing bowl. The coin hopper dispenses coins one by one using a rotary disk fixed on a rotary shaft, rotated by a driving apparatus. At least a part of a surface of the rotary disk includes a conductor, and the conductor is electrically connected to a detecting terminal disposed in the storing bowl.

According to another feature, the conductor may be electrically connected to the rotary shaft of the rotary disk, and the rotary disk may be electrically connected to the detecting terminal. The rotary shaft may be connected to the detecting terminal via an electrical universal connector. The electrical universal connector may include at least a sphere whose surface has conductivity. The electrical universal connector may include a recessed portion formed on a lower end face of the rotary shaft and a connecting member retaining the sphere on the recessed portion. The recessed portion may advantageously be conical. The connecting member may comprise a plate having a spring property.

With a configuration according to the invention, coins in the storing bowl are separated and dispensed one by one by rotation of the rotary disk. When there is a predetermined amount or more of coins in the storing bowl, the detecting terminal positioned in the storing bowl and the conductor of the rotary disk are electrically connected to each other by conductive coins, so that a coin existing signal can be output by detecting the electrical conduction. When the coins in the storing bowl are reduced based on a feed out of the coins, the conductor of the rotary disk and the detecting terminal are not in electrical contact with each other via the coins. Therefore, the coin empty signal can be output by detecting non-conduction between the rotary disk and the detecting terminal. Since a remaining coin amount is detected depending on the presence or absence of electrical connection between the conductor of the rotary disk and the detecting terminal, there is an advantage that the base on which a coin slides can be made of non-conductive resin or the like. And since the conductor of the rotary disk and the detecting terminal in the storing bowl is cleaned by frictional contact with coins, there is an advantage that periodical maintenance is not required. Further, since the detecting terminal is disposed just above the rotary disk, there is an advantage that a coin retaining amount which is as small as possible can be detected.

In the remaining coin amount detecting apparatus for the coin hopper according to the invention, since the conductor is electrically connected to the rotary shaft of the rotary disk, and the rotary shaft are electrically connected to the detecting terminal, the rotary shaft on which the rotary disk is mounted and the detecting terminal are electrically conducted by remaining coins. Therefore, in addition to the above-described effect, there is an advantage that there is no portion where electrical conduction by coins is unstable, so that the electrical conduction can be reliably detected. With the feature that the rotary shaft is connected to the detecting terminal via the electrical universal connector, there is an advantage that electrical connection between the rotary shaft and the detecting terminal are preferably performed if the rotary shaft rotates, so that the conduction can be reliably detected. With the feature that the electrical universal connector includes a sphere whose surface has conductivity, the rotary shaft rotates, and the sphere can revolve omnidirectionaly if core deviation occurs, connection between the rotary shaft and the detecting terminal can be continued via the sphere. Therefore, there is an advantage that electrical connection between the rotary shaft and the detecting terminal can be constantly continued, so that conduction can be detected reliably. With the electrical universal connector including the recessed portion formed on the lower end face of the rotary shaft and the connecting member retaining the sphere on the recessed portion, the sphere is stored on the recessed portion formed on the lower end face of the rotary shaft rotating integrally with the rotary disk by the connecting member. In other words, the sphere is stored at a predetermined position by a peripheral wall forming the recessed portion of the rotary shaft. When the rotary shaft rotates, a rotating force is applied to the sphere from the rotary shaft, and centrifugal force acts on the sphere. Thereby, the sphere is brought in pressure contact with the peripheral wall of the recessed portion, so that electrical conductivity between the sphere and the peripheral wall is increased. Therefore, there is an advantage that electrical conductance can be detected reliably via the sphere if the rotary shaft rotates. With the feature that the recessed portion is conical, the sphere is brought in pressure contact with the conical recessed portion by centrifugal force generated by rotation. Due to the pressure contact, the sphere is caused to approach the connecting member by an inclined face of the conical recessed portion. Therefore, contact pressure between the sphere and the connecting member is increased, so that there is an advantage that electrical conduction can be detected reliably via the sphere if the rotary shaft rotates. With the feature that the connecting member is made of a plate having a spring property, the sphere is pressed into the recessed portion by the plate-like connecting member having such a spring property. Thereby, contact between the sphere and the rotary shaft and contact between the sphere, and the contact member can be continued at a predetermined contact pressure. There is an advantage that conduction can be detected reliably.

According to the present invention a remaining coin amount detecting apparatus is provided for a coin hopper which is disposed on a lower portion of a cylindrical storing bowl and dispenses coins one by one using a rotary disk fixed on a rotary shaft rotated by a driving apparatus. With a preferred embodiment, the rotary disk includes a conductor, the rotary disk is electrically connected to the rotary shaft having conductivity, the rotary shaft is connected to a detecting terminal via an electrical universal connector, the electrical universal connector includes a conical recessed portion formed on a lower end face of the rotary shaft and a connecting member made of a spring plate retaining the sphere on the recessed portion.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF A PREFERRED EMBODIMENT

Figure 1:
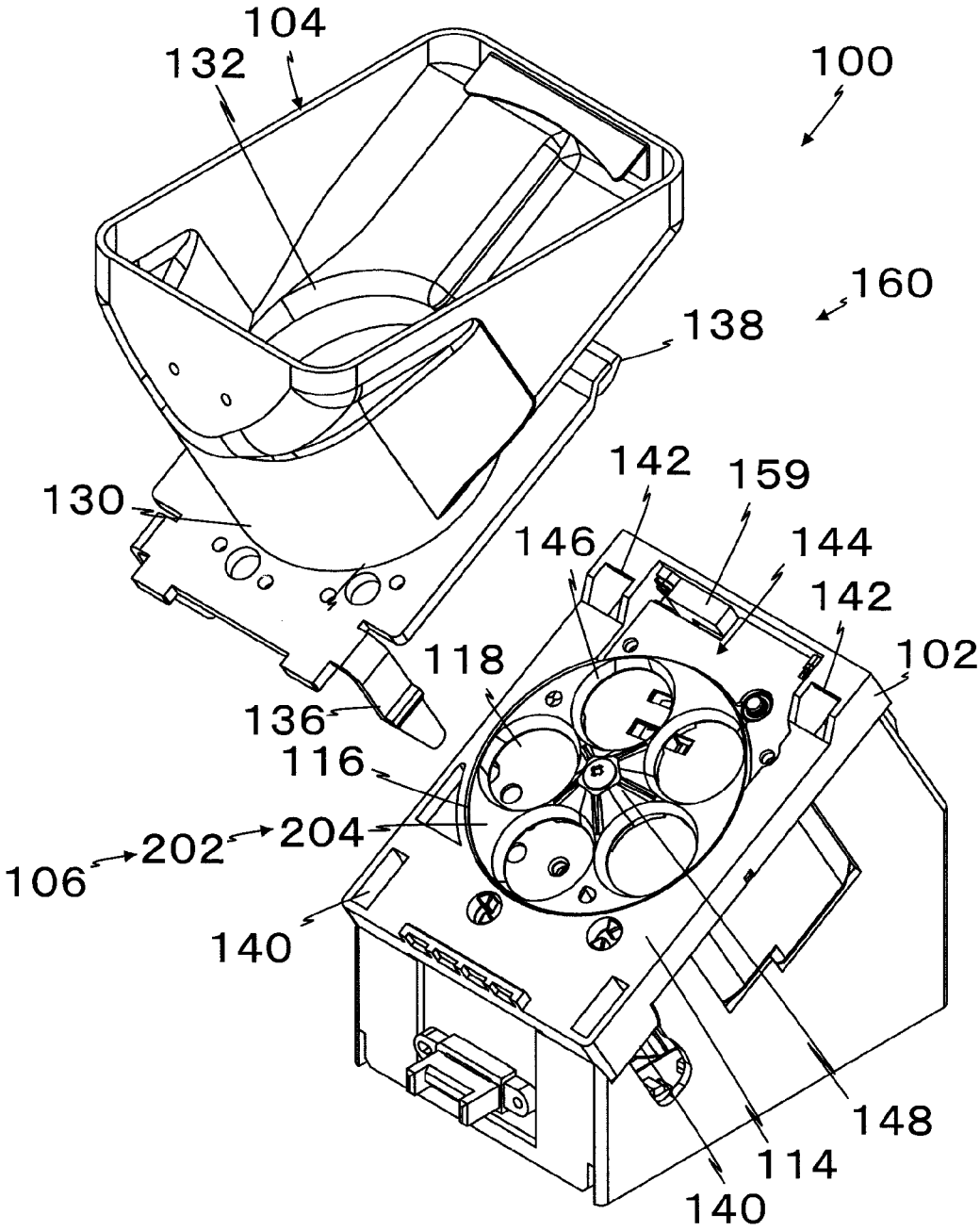
FIG. 1 is an exploded perspective view of a coin hopper provided with a remaining coin amount detecting apparatus according to an embodiment of the present invention.

Referring to the drawings in particular, one example of a coin hopper 100, to which the present invention is to be mounted will first be explained. The coin hopper 100 includes a boxy base 102, a cylindrical storing bowl 104 mounted attachable to and detachably from the base 102, a rotary disk 106, and a driving apparatus 108.

The base 102 has at least a function of guiding coins pushed and moved by the rotary disk 106 and has, for example, a cylindrical shape having a top board such that its upper end face is closed. Though the base 102 can be made from metal, it is preferable that non-conductive resin is molded in view of a relationship between facilitation and cost of manufacture. For example, it is possible to mold a top board and a cylinder portion as members separated from each other and combine them. The base 102 incorporates the driving apparatus 108 and a reducing mechanism 112 described later in an inner space 110. A circular recessed portion 116, which is slightly deeper than the thickness of the rotary disk 106, is formed on an upper face 114 of the base 102. The upper face 114 of the base 102 of the embodiment is inclined downward from the back. A bottom face 118 of the circular recessed portion 116 is a slide face 120 on which a coin lower face slides, and an inner peripheral face 122 is a guide face 124. In this embodiment, a slide plate 126 made of stainless steel is fit in the circular recessed portion 116 of the base 102 made of resin. Therefore, an upper face of the slide face 126 is the slide face 120.

The storing bowl 104 has the function of retaining coins C to be dispensed by the rotary disk 106. The storing bowl 104 of this embodiment has a cylindrical shape extending vertically, an inner face of a lower end portion 130 is concentric with the circular recessed portion 116. An upper end opening 134 is formed into an rearwardly extending long rectangle on a circular hole 132, the diameter of which is slightly smaller than that of the circular recessed portion 116. The storing bowl 104 is fixed attachable to and detachably from the base 102 by putting its lower end face to the upper face 114 of the base 102 and engaging locking units 136 and 138 with corresponding engaging portions 140 and 142 of the base 102.

The rotary disk 106 has the function of separating the coins C stored in the storing bowl 104 one by one and sending them to an exit 144. In this embodiment, the rotary disk 106 has a circular disk shape, on which a plurality of through holes 146 the diameters of which is slightly larger than that of a coin is formed at predetermined intervals, and at a center of which a mountain-shaped sting projection 148 is formed, and further, on a back face of which a pushing and moving ridge-like projection 150 for pushing and moving a coin is formed. The rotary disk 106 is disposed in the circular recessed portion 116, a lower end of the pushing and moving ridge-like projection 150 is rotated by the driving apparatus 108 so as to rotate while keeping a distance from the slide face 120 which is smaller than the thickness of the coin C. An outer peripheral edge of the through hole 146 of the rotary disk 106 is disposed just below a lower edge of the circular hole 132. Due to this disposition, the coin C lying on an inner face of the circular hole 132 falls through the through hole 146 without being supported by an outer peripheral edge of the rotary disk 106. The coin pushing and moving ridge-like projection 150 extending from a central portion to a peripheral edge is formed on a lower face of a rib 152 between the through holes 146 of the rotary disk 106. A triangular-pyramidal sting projecting portion 154 is formed on an upper face of the peripheral edge of the rotary disk 106. The coin hopper 100 retains the coins C in bulk in the storing bowl 104. When the rotary disk 106 rotates, the coins C are stirred by the through holes 146, the sting projection, and the sting projecting portion 154 of the rotary disk 106 to change the posture/position of the coins C variously, such that the coins are caused to fall through the through holes 146, and supported by the slide face 120 of the base 102.

In this case, since a peripheral face of the coin C is pushed by the pushing and moving ridge-like projection 150 on the lower face of the rotary disk 106, the coin C is moved while being guided by the rotary disk 106 and the guide face 124 which is the inner peripheral face 122 of the circular recessed portion 116. In the course of this movement, the coins C are guided in a peripheral direction of the rotary disk 106 by a first pin 156 and a second pin 158 which project from the slide face 120, and sent out one by one to the exit 144.

The coins C sent out are flipped out by a dispensing apparatus (not shown) including, for example, a pair of a stationary guide roller and a moving guide roller. The coins C flipped out are detected by a metal sensor 159, and a detecting signal of the metal sensor 159 is used for counting the number of the coins C discharged. The coins C which have passed through the metal sensor 159 are guided to a predetermined position by a dispensing chute (not shown).

The driving apparatus 108 has the function of rotating the rotary disk 106 at least in a forward direction (counterclockwise direction in FIG. 2) of an arrow for dispensing the coins C. In this embodiment, the driving apparatus 108 also has the function of rotating the rotary disk 106 in an inverse direction (clockwise direction in FIG. 2) for resolving a coin jam. In this embodiment, the driving apparatus 108 includes at least an electric motor 160, a reducing mechanism 112, and a rotary shaft 164.

The rotary shaft 164 has the function of rotating the rotary disk 106 in the appropriate direction, the rotary shaft 164 penetrates the slide plate 126 to project at a center of the circular recessed portion 116, and a distal end of the rotary shaft 164 is inserted into a fitting hole 166 formed at a center of the rotary disk 106 and fixed by a lock screw 168. The rotary shaft 164 is rotatably mounted on the base 102 and a casing 169 of the reducing mechanism 112 such that the rotary shaft 164 is perpendicular to the slide face 120. The rotary shaft 164 is electrically conductive so as to electrically connect a conductor 202 of the rotary disk 106 described later and an electrical universal connector 212. In this context being electrically conductive includes the case in which the rotary shaft 164 is made of metal which is material having conductivity, and the case in which the rotary shaft 164 itself is non-conductive but it has conductivity due to a lead wire or other conductive portion incorporated or provided on the outside. In this embodiment, the rotary shaft 164 is formed from stainless steel to satisfy both aspects of conductivity and strength. However, the rotary shaft 164 can also be made of iron inexpensively.

The reducing mechanism 112 has the function of decelerating rotation of the electric motor 160 and transmitting power to the rotary shaft 164. The reducing mechanism 112 has a first fixed shaft 170 and a second fixed shaft 171 whose axial lines are disposed in parallel with a shaft line L1 of the rotary shaft 164 by the base 102 and the casing 169. On the first fixed shaft 170 there is rotatably supported a first intermediate gear 176 which is a first driven gear 172 vertically integrated with a first drive gear 174 by resin molding. On the second fixed shaft 171 there is rotatably supported a second intermediate gear 182 which is a second driven gear 178 vertically integrated with a second drive gear 180 by resin molding. On the rotary shaft 164 there is fixed a third driven gear 184 molded integrally with resin. A pinion gear 186, fixed on an output shaft 185 of the electric motor 160, meshes with the first driven gear 172. The first drive gear 174 meshes with the second driven gear 178, and the second drive gear 180 meshes with the third driven gear 184. Therefore, rotation of the electric motor 160 is decelerated by the first intermediate gear 176, the second intermediate gear 182, and the third driven gear 184 and transmitted to the rotary shaft 164, and the rotary disk 106 is rotated at a predetermined speed. Since the first intermediate gear 176, the second intermediate gear 182, and the third driven gear 184 are molded resin, the rotary shaft 164 and the first fixed shaft 170 and the second fixed shaft 171 are electrically insulated.

Though one example of the coin hopper 100 to which the present invention is to be mounted has been described above, the present invention is not limited to this example, and any hopper can be applied to the present invention as long as it includes a combination of the storing bowl 104 and the rotary disk 106. For example, the present invention can be applied to the coin hopper 100 where the rotary disk 106 is disposed horizontally.

The remaining coin amount detecting apparatus 200 according to the present invention has the function of detecting an amount of the coins C existing in the storing bowl 104. The remaining coin amount detecting apparatus 200 includes the rotary disk 106 at least one portion of a surface of which is made of a conductor 202 and a detecting terminal 206. The conductor 202 of the rotary disk 106 and the detecting terminal 206 are electrically connected, and they can be conducted via the conductive coins C existing in the storing bowl 104. At least one portion of the rotary disk 106 according to the present invention, which is brought in contact with the coins C, is made of the conductor 202. In other words, at least an upper face 204 of the rotary disk 106 is made of the conductor 202 having conductivity. In this embodiment, the rotary disk 106 is integrally molded by sintering metal powder in order to obtain electrical conductivity, taking into account abrasion resistance for contact with the coins C as described above, so that the whole rotary disk 106 is the conductor 202. However, the basic or parent material of the rotary disk 106 is molded with resin, and an upper face thereof can be covered with the conductor 202 made of a circular metal cover pressed on. The rotary disk 106 can be integrally molded with resin having conductivity to make the whole rotary disk 106 into the conductor 202. Further, fine conductors 202 can be dotted on the upper face 204 of the rotary disk 106 to make a front face of the upper face 204 into the conductor 202.

The detecting terminal 206 is disposed above the rotary disk 106, and disposed so as to be capable of being electrically conducted to the conductor 202 of the rotary disk 106 due to the coins C in the storing bowl 104. In this embodiment, the detecting terminal 206 is a first conducting plate 208 fixed on the inner face of the circular hole 132 of a lower portion of the storing bowl 104, which is positioned just above the rotary disk 106 at an interval smaller than a diameter of a coin. The first conductive plate 208 can be made of metal having conductivity, a plate subjected to conductive plating, or the like. In this configuration, when a lower end peripheral face of the coin C is supported by the conductor 202 of the rotary disk 106 or another coin C positioned on the through-hole 146, and an upper end peripheral edge thereof lies on the detecting terminal 206, the conductor 202 of the rotary disk 106 and the detecting terminal 206 are conductive as to each other by the coin C having conductivity. By detecting the conduction using the remaining amount detecting circuit 210, a coin signal CS can be output. The detecting terminal 206 can be made by inserting an electrode into the storing bowl 104.

The remaining amount detecting circuit 210 has a function of detecting electrical conduction between the conductor 202 of the rotary disk 106 and the detecting terminal 206 due to the coin C. The remaining amount detecting circuit 210 includes the conductor 202 of the rotary disk 106, the rotary shaft 164, the electrical universal connector 212, a detector 214, and the detecting terminal 206. In other words, the conductor 202 of the upper face 204 of the rotary disk 106 is electrically connected to the rotary shaft 164 having conductivity, and the rotary shaft 164 is electrically connected to the detector 214 via the electrical universal connector 212. The detector 214 is electrically connected to the detecting terminal 206. Due to this configuration, when the conductor 202 of the rotary disk 106 and the detecting terminal 206 are conductive as to each other via the coin C, the detector 214 outputs the coin signal CS, and when they are not conducted, an empty signal ES is output. When all the coins C on the rotary disk 106 have fallen through the through hole 146, the rotary disk 106 and the detecting terminal 206 are not conductive as to each other by the coin C, so that the detector 214 outputs the empty signal ES. By operating a coin replenishing apparatus (not shown) or issuing an empty alarm in response to the empty signal ES, the coins C can be replenished in the storing bowl 104. When the coins C are money (currency), the configuration that the detecting terminal 206 is disposed just above the rotary disk 106 has an advantage that a replenishing interval of the coins C can be elongated, since the empty signal ES is output in a state in which there are less coins C.

As a detecting terminal 206, a second conductor 216 fixed on an upper inner face of the storing bowl 104 can be used. When the second conductor 216 is used, the empty signal ES can be output in a state in which a remaining amount of the coins C is relatively large. This configuration is preferable when an amount of coin consumption per unit time is large, for example, when the coin hopper 100 is used as a dispensing apparatus which dispenses a prize medal in a pachinko-slot machine or similar gaming device.

The electrical universal connector 212 has the function of electrically connecting the conductor 202 of the rotary disk 106 and the detecting terminal 206. More specifically, the electrical universal connector 212 has a function of electrically connecting the rotary shaft 164 rotating the rotary disk 106 and the detecting terminal 206. Since the electrical universal connector 212 electrically and constantly connects a conducting path between the rotary shaft 164 and a connecting member 226 on the side of the detecting terminal 206 fixed and disposed even if the rotary shaft 164 rotates, there is an advantage that electrical conduction between the rotary shaft 164 and the detecting terminal 206 can be detected reliably. Therefore, the electrical universal connector 212 can be exchanged with an apparatus having the same function, for example, a collector ring.

The configuration of the electrical universal connector 212 which is inexpensive enough to be suitable for the coin hopper 100, and excellent in durability will be explained. The electrical universal connector 212 includes a sphere 222, a recessed portion 224 formed on a lower end face of the rotary shaft 164, and the connecting member 226. The sphere 222 is formed into a ball, one portion of which is brought in contact with an inner face of the recessed portion 224, and at least a surface thereof has conductivity. Though the sphere 222 is, for example, a stainless steel ball which does not develop rust, an iron ball whose surface is subjected to conductive plating or the like can be used. The connecting member 226 is, for example, a plate piece having resilience formed with a spring member having conductivity, one end thereof is fixed on the casing 169 with screw 228. The other end of the connecting member 226 is put on a lower end of the sphere 222, and presses up the sphere 222 such that an upper end portion of the sphere is pressed into the recessed portion 224. It is preferable that the recessed portion 230 is formed at a portion of the connecting member 226 brought in contact with the sphere 222, and the sphere 222 is stored so as not to drop out of the recessed portion 230. In this configuration, the sphere 222 is constantly biased by the connecting member 226 such that the sphere 222 is pressed into the recessed portion 224. Therefore, the sphere 222 does not drop out of the recessed portion 224, further, the rotary shaft 164 and the sphere 222 are constantly brought in close contact with each other at a predetermined pressure, and the sphere 222 and the connecting member 226 are constantly brought in close contact with each other at a predetermined pressure, so that conductivity is continued. In this configuration, even when a rotary axial line of the recessed portion 224 is deviated with respect to the rotary shaft 164, namely, a rotary axial line of the rotary shaft 164, the sphere 222 generates centrifugal force due to the rotating force received from the rotary shaft 164, and the sphere 222 is brought in pressure contact with a peripheral face of the recessed portion 224 by the centrifugal force. Since the sphere is movable omnidirectionaly, an electrical connection between the inner face of the recessed portion 224 and the surface of the sphere 222 is continued. Further, since the connecting member 226 presses the sphere 224 against the recessed portion 224 constantly, electrical connection between them is continued. Therefore, electrical connection between the rotary shaft 164 and the connecting member 226 can be kept to conduct the rotary disk 106 and the connecting terminal 202, so that there is an advantage that the empty signal ES can be output reliably.

It is preferable that the recessed portion 224 is a conical recessed portion. The sphere 222 rotates according to rotation of the rotary shaft 164, receives centrifugal force, and comes in pressure contact with an inner peripheral face of the conical recessed portion. Due to this pressure contact, the sphere 222 is moved to the side of the connecting member 226 along an inclined face of the conical recessed portion. Therefore, contact pressure between the sphere 222 and the rotary shaft 164 and contact pressure between the sphere 222 and the connecting member 226 are increased, so that there is an advantage that electrical conduction can be detected reliably via the sphere 222 if the rotary shaft 164 rotates.

The electrical universal connector 212 can be configured such that the lower end of the rotary shaft 164 is made into a conical shape to form a projection, and the projection is brought in contact with the connecting member 226 at a predetermined pressure. Conversely, such a configuration can be made that a lower face of the rotary shaft 164 is made flat, a projection is formed on the connecting member 226, and the projection is brought in contact with the lower face of the rotary shaft at a predetermined pressure. In this case, a distal end of the projection is brought in contact with a rotating center of the rotary shaft 164. Thereby, a slide force does not act between the projection and the connecting member 226, so that electrical connection between the distal end of the projection and the connecting member 226 becomes stable.

Figure 2:
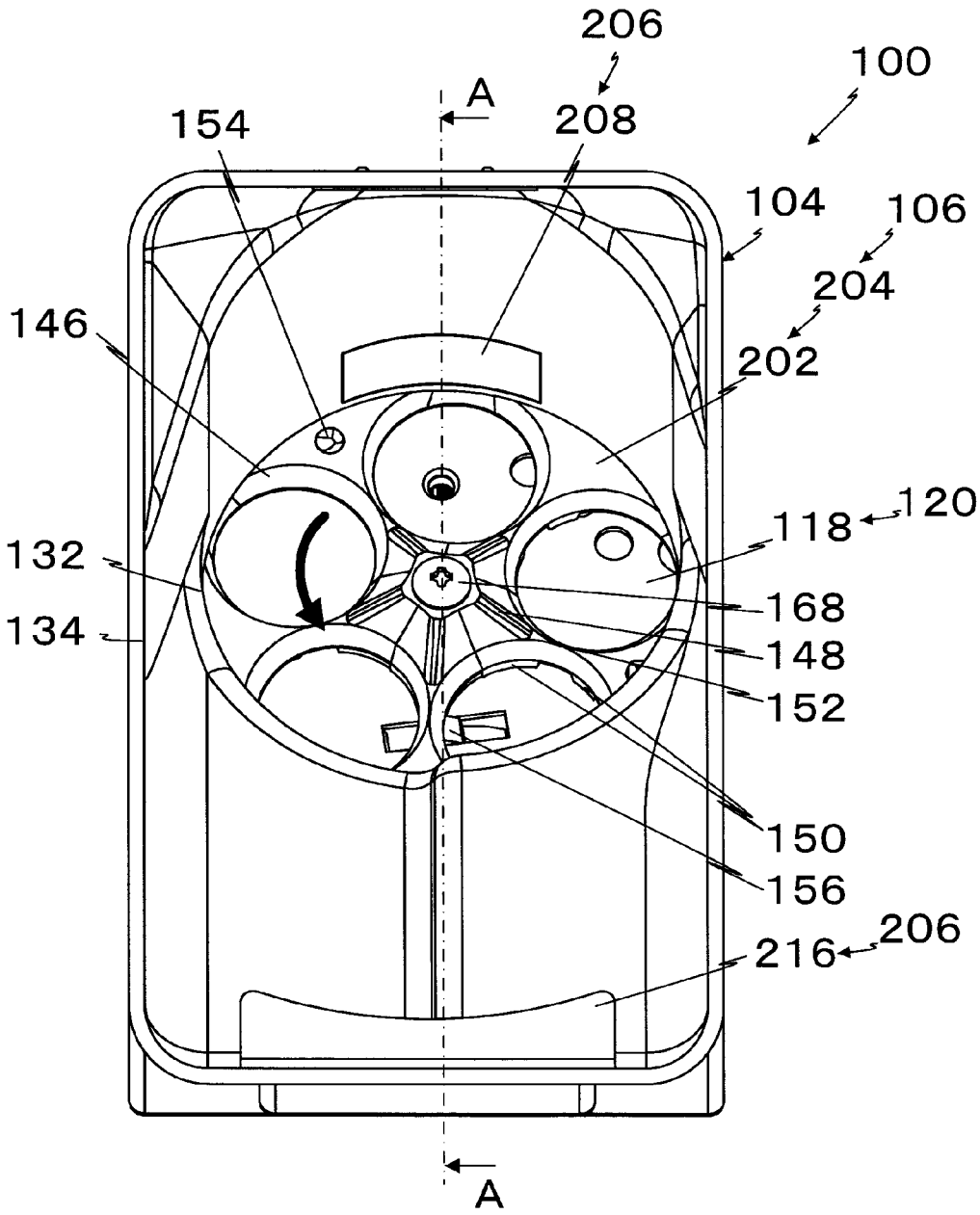
FIG. 2 is a plan view of the coin hopper provided with the remaining amount detecting apparatus according to the embodiment of the present invention.
Figure 3:
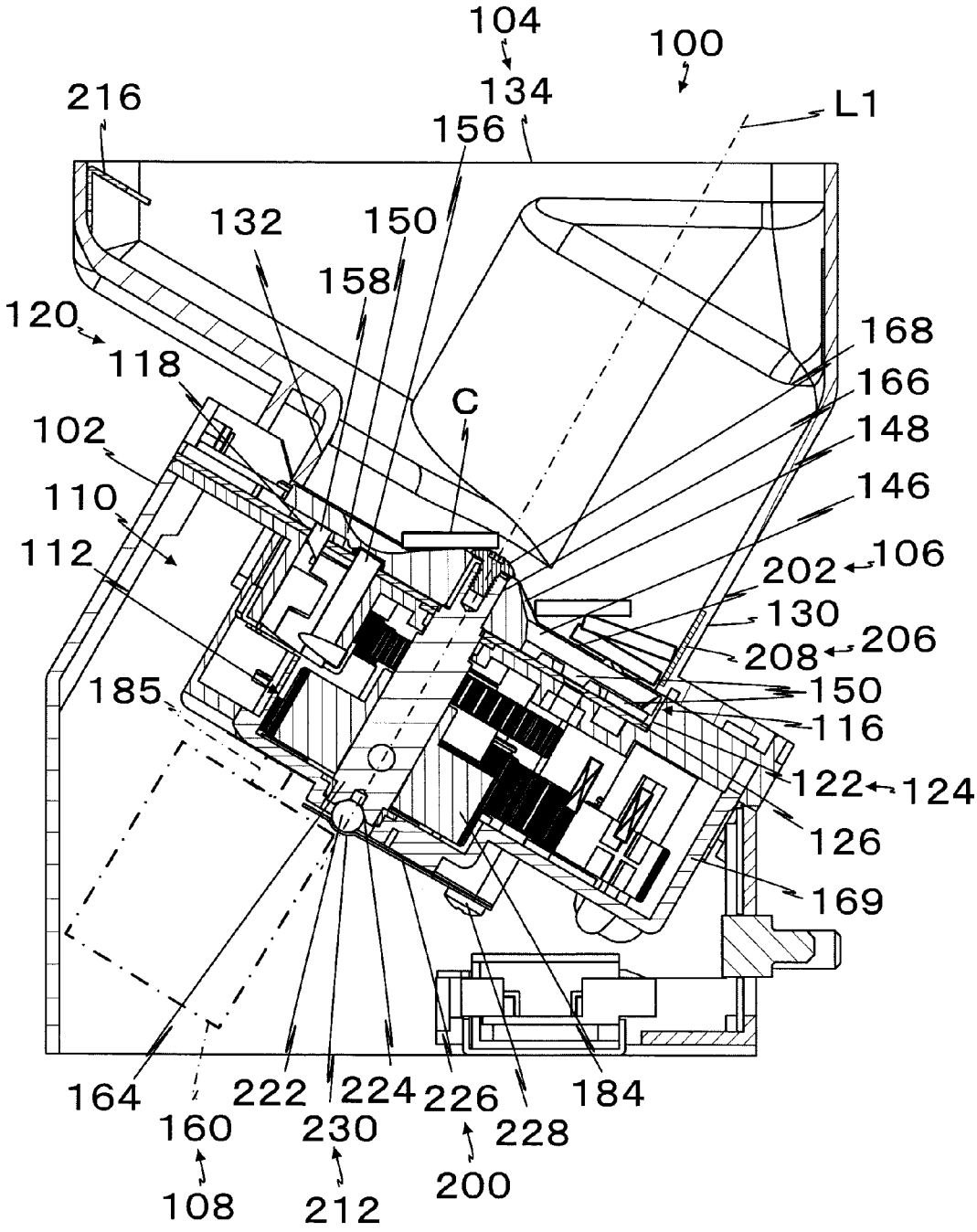
FIG. 3 is a sectional view of the coin hopper, taken along line A-A in FIG. 2.
Figure 4:
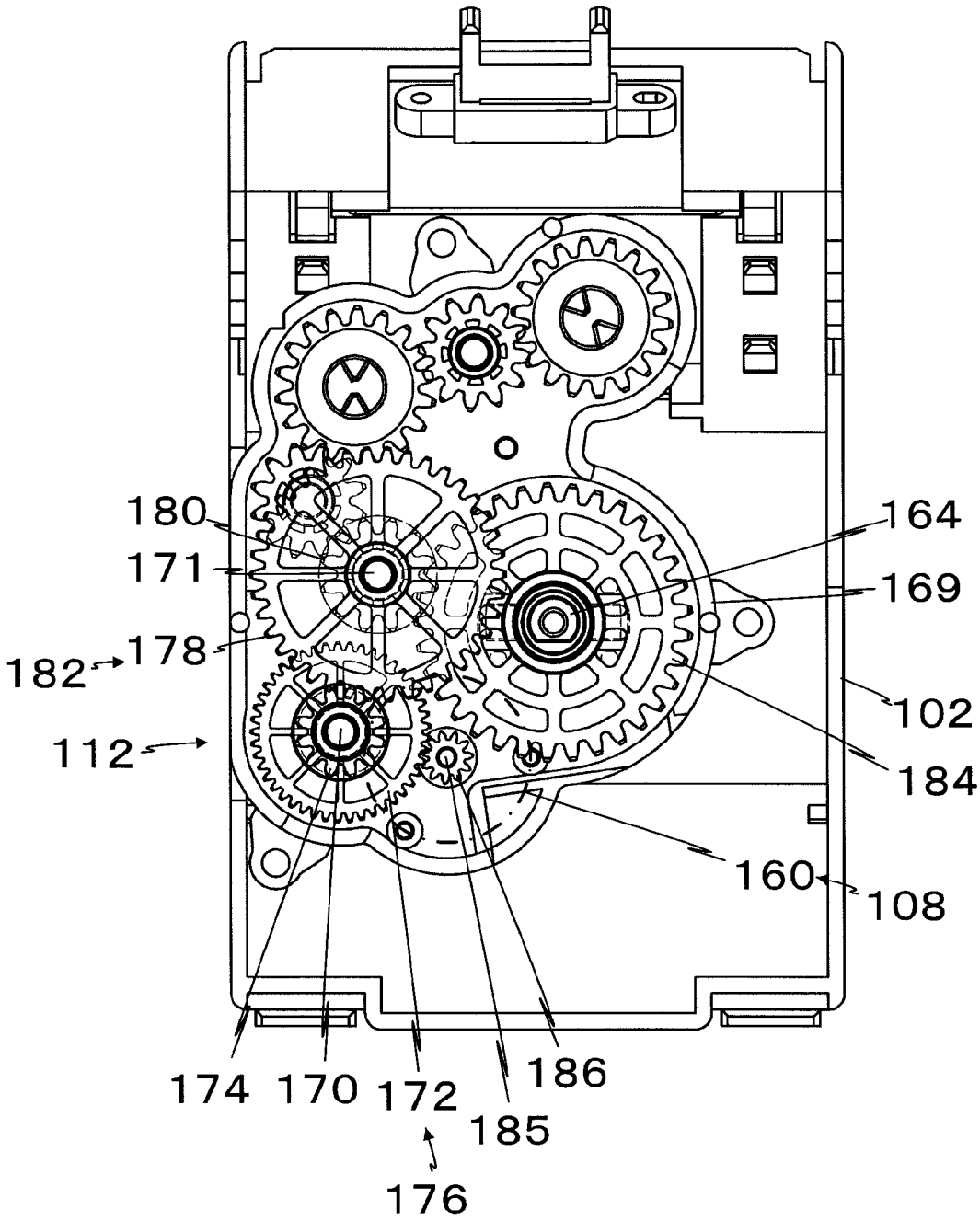
FIG. 4 is a bottom plan view of the coin hopper in FIG. 3 in a state in which a casing is removed.
Figure 5:
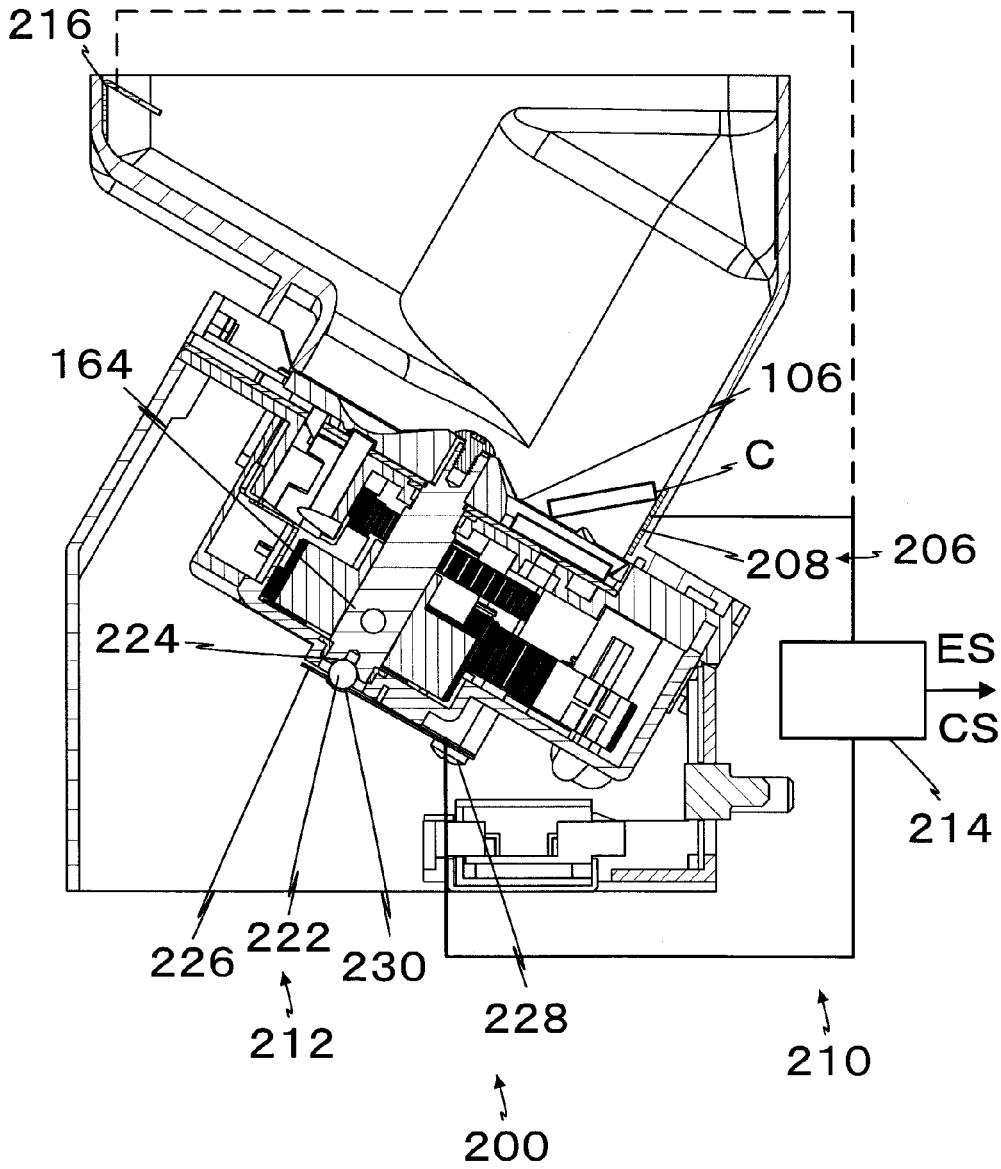
FIG. 5 is a detecting circuit view of the remaining coin amount detecting apparatus for the coin hopper according to the embodiment of the present invention.

Next, operation of this embodiment will be explained. Several of the coins C are stored in bulk in the storing bowl 104. In FIG. 1 and FIG. 2, the rotary disk 106 is rotated in a counterclockwise direction by positive rotation of the electric motor 160. Thereby, the pinion gear 186 is rotated, the rotary shaft 164 is rotated via the first intermediate gear 176, the second intermediate gear 182, and the third driven gear 184, and the rotary disk 106 is rotated in a counterclockwise direction. Thereby, the coin C falls through the through-hole 146, and the lower face of the coin C is supported by the slide face 120. Due to rotation of the rotary disk 106, the coin C is rotated and moved in a counterclockwise direction in FIG. 2 while being guided to the guide face 124 of the circular recessed portion 116 in a counterclockwise direction by the pushing and moving ridge-like projection 150. Since the coin C is prevented from rotating and moving by the first pin 156 and the second pin 158, the coin C is moved in a peripheral direction of the rotary disk 106 to be dispensed by the dispensing apparatus (not shown).

Since the sphere 222 is pressed against the recessed portion 224 by the connecting member 226, when the rotary shaft 164 rotates, the inner face of the recessed portion 224 and the outer peripheral face of the sphere 222 are brought in contact with each other at least one portion. In other words, the inner face of the recessed portion 224 and the sphere 222 are conductive as to each other. A lower end portion of the sphere 222 and the connecting member 226 are brought in contact with each other by the pressing force. In other words, the sphere 222 and the connecting member 226 are electrically conductive with respect to each other. Therefore, when the coin C comes in contact with rotary disk 106 (the conductor 202), and comes in contact with the detecting terminal 206, the detector 214 is conducting via the coin C, so that the detector 214 outputs the coin signal CS. When the coins C are reduced, and there are no coins C present on the rotary disk 106, the rotary disk 106 and the detecting terminal 206 are not conductive as to each other, the detector 214 outputs the empty signal ES. By operating the replenishing apparatus in response to the empty signal ES or the like, the coins C can be automatically replenished to the storing bowl 104, or by outputting a replenishment instructing signal, replenishment of the coins C can be prompted.

In the present invention, when the driven gear 184 and the second intermediate gear 182 are made of metal, the electrical universal connector 212 can be made by utilizing a lower end of the second rotary shaft 171. However, since lubricant oil or the like makes an insulating layer between the gears, it is preferable to make the electrical universal connector 212 by utilizing the rotary shaft 164 on which the rotary disk 106 is fixed.

While a specific embodiment of the invention has been shown and described in detail to illustrate the application of the principles of the invention, it will be understood that the invention may be embodied otherwise without departing from such principles.

What is claimed is:

1. A remaining coin amount detecting apparatus and coin hopper comprising:

a coin hopper storing bowl;

a rotary disk for dispensing coins from the storing bowl one by one;

a driving apparatus;

a rotary shaft rotated by said driving apparatus, said rotary disk being mounted on said rotary shaft; and a detecting apparatus disposed on a lower portion of said storing bowl including at least a portion of a surface of the rotary disk comprising a conductor and a detecting terminal disposed in the storing bowl, said conductor being electrically connected to said detecting terminal through coins in said coin hopper storing bowl for detecting an amount of remaining coins.

2. A remaining coin amount detecting apparatus and coin hopper according to claim 1, wherein said conductor is electrically connected to said rotary shaft, and said rotary shaft is electrically connected to form a circuit with said detecting terminal for detecting an amount of remaining coins.

3. A remaining coin amount detecting apparatus and coin hopper according to claim 2, wherein said rotary shaft is connected to form a circuit via an electrical universal connector.

4. A remaining coin amount detecting apparatus and coin hopper according to claim 3, wherein the electrical universal connector includes at least a sphere having an electrically conductive surface.

5. A remaining coin amount detecting apparatus and coin hopper according to claim 4, wherein the electrical universal connector includes a recessed portion formed on a lower end face of the rotary shaft and a connecting member retaining the sphere on the recessed portion.

6. A remaining coin amount detecting apparatus and coin hopper according to claim 5, wherein the recessed portion is conical.

7. A remaining coin amount detecting apparatus and coin hopper according to claim 5, wherein said connecting member comprises a plate having a spring property.

8. A coin hopper with remaining coin detection, the coin hopper comprising:

a coin hopper storing bowl;

a rotary disk disposed on a lower portion of said storing bowl for dispensing coins from the storing bowl one by one;

a driving apparatus;

a rotary shaft rotated by said driving apparatus, said rotary disk being mounted on said rotary shaft; and a remaining coin detecting means for detecting coins remaining in the coin hopper storing bowl, said remaining coin detecting means comprising a detector element, an electrically conductive portion of said rotary disk, said electrically conductive portion being electrically connected to said detector element and a detecting terminal electrically connected to said detector element, said detecting terminal being disposed in the storing bowl, said detector element providing a detection signal based on said conductive portion being in electrically contact with said detecting terminal via coins in said hopper storing bowl.

9. A coin hopper according to claim 8, wherein said conductive portion of said rotary disk is electrically connected to said rotary shaft, and said rotary shaft is electrically connected to said detecting element.

10. A coin hopper according to claim 9, wherein said rotary shaft is connected to said detecting element via an electrical universal connector.

11. A coin hopper according to claim 10, wherein the electrical universal connector includes at least a sphere having an electrically conductive surface.

12. A coin hopper according to claim 11, wherein the electrical universal connector includes a recessed portion formed on a lower end face of the rotary shaft and a connecting member retaining the sphere on the recessed portion.

13. A coin hopper according to claim 12, wherein the recessed portion is conical.

14. A coin hopper according to claim 13, wherein said connecting member comprises a plate having a spring property.

15. A coin hopper with remaining coin detection, the coin hopper comprising:

a coin hopper storing bowl;

a rotary disk disposed in communication with an interior of said storing bowl for dispensing coins from the storing bowl one by one;

a driving apparatus;

a rotary shaft rotated by said driving apparatus, said rotary disk being mounted on said rotary shaft; and a remaining coin detecting means for detecting coins remaining in the coin hopper storing bowl and providing a signal indicating the presence or absence of detected remaining coins, said remaining coin detecting means comprising a detector element for output of said signal, an electrically conductive portion of said rotary disk, said electrically conductive portion being electrically connected to said detector element and a detecting terminal electrically connected to said detector element, said detecting terminal being disposed in the storing bowl.

* * * * *